US009707459B1

(12) United States Patent
Myers

(10) Patent No.: US 9,707,459 B1
(45) Date of Patent: Jul. 18, 2017

(54) GOLF CLUB HEAD WITH ADJUSTABLE CENTER OF GRAVITY

(71) Applicant: Callaway Golf Company, Carlsbad, CA (US)

(72) Inventor: Matthew Myers, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 57 days.

(21) Appl. No.: 15/043,196

(22) Filed: Feb. 12, 2016

Related U.S. Application Data

(63) Continuation-in-part of application No. 14/175,657, filed on Feb. 7, 2014, now Pat. No. 9,364,728, and a continuation-in-part of application No. 14/174,068, filed on Feb. 6, 2014, now Pat. No. 9,289,660, which is a continuation-in-part of application No. 14/163,946, filed on Jan. 24, 2014, now Pat. No. 9,211,453, which is a continuation-in-part of application No. 14/033,218, filed on Sep. 20, 2013, now Pat. No. 8,696,491, which is a continuation-in-part of application No. 13/923,571, filed on Jun. 21, 2013, now Pat. No. 9,084,921, which is a continuation-in-part of application No. 13/778,958, filed on Feb. 27, 2013, now Pat. No. 8,894,506, which is a continuation-in-part of (Continued)

(51) Int. Cl.
*A63B 53/04* (2015.01)
*A63B 53/06* (2015.01)

(52) U.S. Cl.
CPC ..... *A63B 53/06* (2013.01); *A63B 53/0466* (2013.01); *A63B 2053/0433* (2013.01); *A63B 2053/0491* (2013.01)

(58) Field of Classification Search
USPC ..... 473/324–350
See application file for complete search history.

(56) References Cited

U.S. PATENT DOCUMENTS 3,652,094 A * 3/1972 Glover ..... A63B 53/08 473/337
5,688,189 A * 11/1997 Bland ..... A63B 53/065 473/314

(Continued)

FOREIGN PATENT DOCUMENTS

JP 06238022 A * 8/1994
JP 2005323978 A * 11/2005

(Continued)

*Primary Examiner* — Alvin Hunter
(74) *Attorney, Agent, or Firm* — Rebecca Hanovice; Michael Catania; Sonia Lari

(57) ABSTRACT

A golf club head comprising a slidable weight for adjusting the location of the club head center of gravity is disclosed herein. The club head has a channel disposed in its sole and a slidable weight assembly comprising a weight body and a rotatable cam portion. The channel includes a single, L-shaped rail extending upwards from a channel floor, and the slidable weight assembly is reversibly fixed to the rail when the rotatable cam portion is rotated such that a curved protrusion is disposed underneath a ledge of the L-shaped rail. The channel preferably has an S-shaped or closed loop configuration such that the club head's center of gravity can be adjusted along X (front to back) and Y (heel to toe) horizontal axes.

20 Claims, 3 Drawing Sheets

Related U.S. Application Data application No. 13/766,658, filed on Feb. 13, 2013, now Pat. No. 8,790,195.

(60) Provisional application No. 61/905,749, filed on Nov. 18, 2013, provisional application No. 61/898,956, filed on Nov. 1, 2013, provisional application No. 61/893,728, filed on Oct. 21, 2013, provisional application No. 61/727,608, filed on Nov. 16, 2012, provisional application No. 61/746,348, filed on Dec. 27, 2012.

(56) References Cited

U.S. PATENT DOCUMENTS 6,015,354 A * 1/2000 Ahn ..... A63B 53/04 473/256
6,089,994 A * 7/2000 Sun ..... A63B 53/04 473/338
6,277,032 B1 * 8/2001 Smith ..... A63B 53/04 473/336
6,575,845 B2 * 6/2003 Galloway ..... A63B 53/02 473/329
6,945,876 B2 * 9/2005 Nakahara ..... A63B 53/0466 473/329
6,969,326 B2 * 11/2005 De Shiell ..... A63B 53/0466 273/DIG. 7
7,147,573 B2 12/2006 DiMarco
7,166,041 B2 * 1/2007 Evans ..... A63B 53/0466 473/334
7,452,286 B2 * 11/2008 Lin ..... A63B 53/0466 473/334
7,611,424 B2 * 11/2009 Nagai ..... A63B 53/0466 473/334
7,628,711 B2 * 12/2009 Akinori ..... A63B 53/0466 411/337
7,775,905 B2 * 8/2010 Beach ..... A63B 53/0466 473/256
8,016,694 B2 * 9/2011 Llewellyn ..... A63B 53/0466 473/334
8,202,175 B2 * 6/2012 Ban ..... A63B 53/0466 473/334
8,435,135 B2 * 5/2013 Stites ..... A63B 53/0466 473/334
8,684,863 B2 * 4/2014 Bezilla ..... A63B 53/06 473/334
8,696,491 B1 * 4/2014 Myers ..... A63B 53/06 473/334
8,894,506 B1 * 11/2014 Myers ..... A63B 53/0466 473/334
9,084,921 B1 * 7/2015 Liang ..... A63B 53/06
9,174,096 B2 * 11/2015 Sargent ..... A63B 53/0466
9,211,447 B2 12/2015 Harbert et al.
9,636,553 B1 * 5/2017 Myers ..... A63B 53/0466
2005/0137024 A1 * 6/2005 Stites ..... A63B 53/047 473/291
2006/0122004 A1 * 6/2006 Chen ..... A63B 53/0466 473/335
2006/0172821 A1 * 8/2006 Evans ..... A63B 53/0466 473/349
2006/0178228 A1 * 8/2006 DiMarco ..... A63B 53/0466 473/334
2006/0240908 A1 * 10/2006 Adams ..... A63B 53/0466 473/334
2008/0261715 A1 * 10/2008 Carter ..... A63B 53/0466 473/291
2010/0075773 A1 * 3/2010 Casati, Jr. ..... A63B 49/02 473/334
2010/0292027 A1 11/2010 Beach et al.
2015/0306473 A1 * 10/2015 Breier ..... A63B 53/0466 473/336
2016/0001146 A1 1/2016 Sargent et al.

FOREIGN PATENT DOCUMENTS

JP 2006-320493 11/2006
JP 2006320493 A * 11/2006
JP 2008194454 A * 8/2008 ..... A63B 53/0466
JP 2010069106 A * 4/2010 ..... A63B 53/0466
JP 2010136772 A * 6/2010 ..... A63B 53/0466
JP 2010148702 A * 7/2010 ..... A63B 53/0466
JP 2010252964 A * 11/2010
JP 2011010722 A * 1/2011

* cited by examiner

GOLF CLUB HEAD WITH ADJUSTABLE CENTER OF GRAVITY

CROSS REFERENCES TO RELATED APPLICATIONS

The present application is a continuation-in-part of U.S. patent application Ser. No. 14/175,657, filed on Feb. 7, 2014, which claims priority to U.S. Provisional Patent Application Nos. 61/905,749, filed on Nov. 18, 2013, 61/898,956, filed on Nov. 1, 2013, and 61/893,728, filed on Oct. 21, 2013, and is a continuation-in-part of U.S. patent application Ser. No. 14/174,068, filed on Feb. 6, 2014, which is a continuation-in-part of U.S. patent application Ser. No. 14/163,946, filed on Jan. 24, 2014, and issued on Dec. 15, 2015, as U.S. Pat. No. 9,211,453, which is a continuation-in-part of U.S. patent application Ser. No. 14/033,218, filed on Sep. 20, 2013, and issued on Apr. 15, 2014, as U.S. Pat. No. 8,696,491, which is a continuation-in-part of U.S. patent application Ser. No. 13/923,571, filed on Jun. 21, 2013, and issued on Jul. 21, 2015, as U.S. Pat. No. 9,084,921, which is a continuation-in-part of U.S. patent application Ser. No. 13/778,958, filed on Feb. 27, 2013, and issued on Nov. 25, 2014, as U.S. Pat. No. 8,894,506, which claims priority to U.S. Provisional Patent Application No. 61/727,608, filed on Nov. 16, 2012, the disclosure of each of which is hereby incorporated by reference in its entirety herein. U.S. patent application Ser. No. 14/163,946 also is a continuation-in-part of U.S. patent application Ser. No. 13/766,658, filed on Feb. 13, 2013, and issued on Jul. 29, 2014, as U.S. Pat. No. 8,790,195, which claims priority to U.S. Provisional Patent Application No. 61/746,348, filed on Dec. 27, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a weight for a golf club head that can be adjusted along one or more channels.

Description of the Related Art

The ability to adjust center of gravity location and weight in the head of driving clubs is useful for controlling performance of the golf club. The prior art includes several different solutions for adjustable weighting, but there still is a need for a weighting mechanism that allows for simple and flexible center of gravity (CG) and moment of inertia (MOI) adjustability along multiple axes.

BRIEF SUMMARY OF THE INVENTION

The present invention presents a novel way of working with adjustable products. The present invention allows consumers to easily move and fix a weight at any location within a single channel disposed in the golf club head in such a way to maximize aesthetic appearances while preserving the function of the movable weight. The objective of this invention is to provide an adjustable weight with minimal or no effect on appearance at address while maximizing the ability of the weight to adjust center of gravity location along horizontal X and Y axes. Additional goals include minimizing the fixed component of the structure dedicated to the weighting system and also minimizing any potential effect on impact sound.

One aspect of the present invention is a golf club head comprising a body comprising a hosel, a striking face, a heel side, a toe side, a rear side, a sole, and a channel in the sole, and a slidable weight assembly comprising a weight body and a rotatable portion, wherein the weight body comprises a planar upper portion, a base portion extending from and perpendicular to the planar upper portion, and at least one rounded nub extending from and approximately perpendicular to the base portion, wherein the rotatable portion comprises a cylindrical body and a curved protrusion extending from and approximately perpendicular to a lower end of the cylindrical body, wherein the curved protrusion extends only partially around the cylindrical body, wherein the planar upper portion comprises an opening sized to receive an upper end of the cylindrical body, wherein the channel comprises a floor and rail extending from and approximately perpendicular to the floor, wherein the rail comprises a stem and a ledge extending approximately perpendicular to and away from the stem, wherein the ledge is spaced from, and approximately parallel with, the floor, and wherein rotating the rotatable portion causes at least a portion of the curved protrusion to slide under the ledge and reversibly fixes the slidable weight assembly to the rail.

In some embodiments, the curved protrusion and the at least one rounded nub may be the only portions of the slidable weight assembly that contact the rail when at least a portion of the curved protrusion is disposed under the ledge. In other embodiments, the channel may have a configuration selected from the group consisting of a closed loop and an S-shape. In any of the embodiments disclosed herein, the curved protrusion may comprise a helical upper surface. In other embodiments, the weight body may be composed of a first material having a first density, and the rotatable portion may be composed of a second material having a second density that is less than the first density. In some embodiments, at least one of the at least one rounded nub and the curved protrusion may be co-molded with a high friction material such as rubber.

In one embodiment, the at least one rounded nub may comprise first and second rounded nubs, each of which may be disposed beneath the planar upper portion. In another embodiment, the curved protrusion may extend less than halfway around the cylindrical body. In some embodiments, the upper end of the cylindrical body may comprise an upper surface having a tool engagement feature. In another embodiment, the upper end of the cylindrical body may be permanently trapped within the opening in the planar upper portion. In any of the embodiments disclosed herein, the golf club head may be selected from the group consisting of a driver-type head, a fairway wood-type head, and a hybrid-type head. In one embodiment, the golf club head may further comprise a composite crown, and the body may be composed of a metal alloy.

Another embodiment of the present invention is a weight assembly comprising a weight body comprising a planar upper portion, a base portion extending from and perpendicular to the planar upper portion, and first and second rounded nubs extending from and perpendicular to the base portion, and a rotatable portion comprising a cylindrical body, a tool engagement feature, and a curved protrusion extending from and perpendicular to the cylindrical body, wherein the planar upper portion comprises an opening sized to receive an upper end of the cylindrical body, wherein the upper end of the cylindrical body is permanently trapped within the opening, wherein each of the first and second rounded nubs are disposed beneath the planar upper portion, wherein the curved protrusion extends less than halfway around the cylindrical body, and wherein the curved protrusion comprises a helical upper surface.

In some embodiments, the weight body may be composed of a first material having a first density and the rotatable portion may be composed of a second material having a second density that is less than the first density. In a further embodiment, the first material may be a tungsten alloy and the second material may be a polymer material. In another embodiment, at least one of the first and second rounded nubs and the curved protrusion may be co-molded with a high friction material. In another embodiment, each of the first and second rounded nubs and the curved protrusion may be co-molded with rubber. In another embodiment, the curved protrusion may extend from a lower end of the cylindrical body. In any of the embodiments disclosed herein, the planar upper portion may comprise an upper surface and a decal may be permanently affixed to the upper surface.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
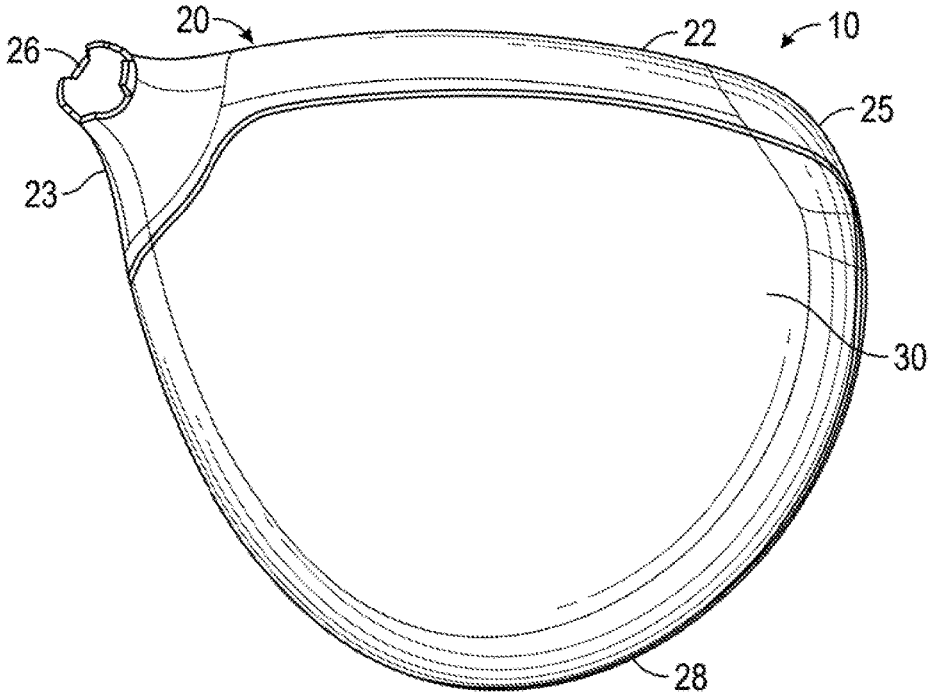
FIG. 1 is a top plan view of a first embodiment of the golf club head of the present invention.

The design approaches described herein are based on a construction used in a driver head characterized by a composite crown adhesively bonded to a cast titanium body. This particular construction approach permits the crown configuration to be adapted to the inventive weighting scheme with minimal impact on weight and function. However, the weighting embodiments disclosed herein can be used with other constructions, including all titanium, all composite, and a composite body with metal face cup. The embodiments may also work in conjunction with at least one adjustable weight port on the club head. Shifting weight along the channel described herein allows for control of center of gravity location and adjustment of other mass properties.

A preferred embodiment of the present invention is shown in FIGS. 1-7. The golf club head 10, which preferably is a driver or a large fairway wood, but may be any type of golf club head, including a hybrid, iron, wedge, or putter, comprises a body 20 having a face 22, a heel side 23 proximate a hosel 26, a toe side 25, a rear edge 28, a sole 40, and an upper opening (not shown) that is covered by a separately formed crown 30. The hosel 26 has a through-bore 27 that extends into the sole 40, which includes an elongated, S-shaped channel 50, though in another embodiment, shown in FIG. 8, the channel 50 may be configured as a closed loop. In some embodiments, the through-bore 27 may connect with the channel 50. The hosel 26 preferably has a structure that permits loft, lie, and face angle adjustability, including any of the structures disclosed in U.S. Pat. Nos. 8,641,554, 8,684,859, 8,696,486, 8,715,103, 8,715,104, 8,727,906, and 8,801,537, the disclosure of each of which is hereby incorporated by reference in its entirety herein.

Figure 2:
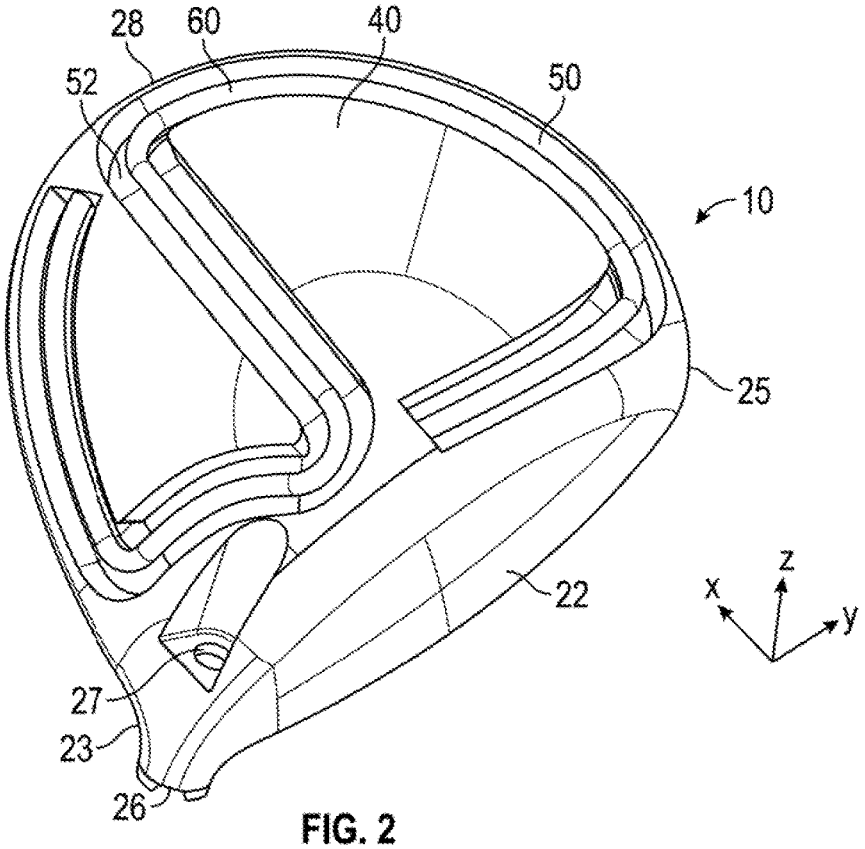
FIG. 2 is a sole perspective view of the embodiment shown in FIG. 1.
Figure 3:
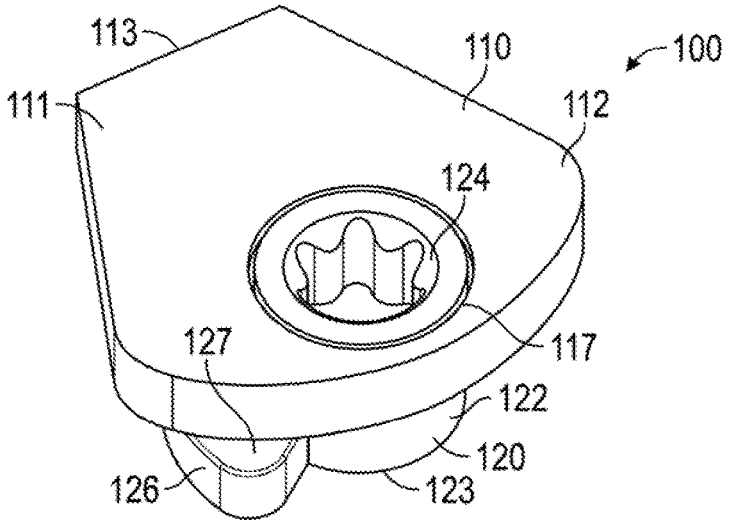
FIG. 3 is a top perspective view of the slidable weight of the present invention.
Figure 4:
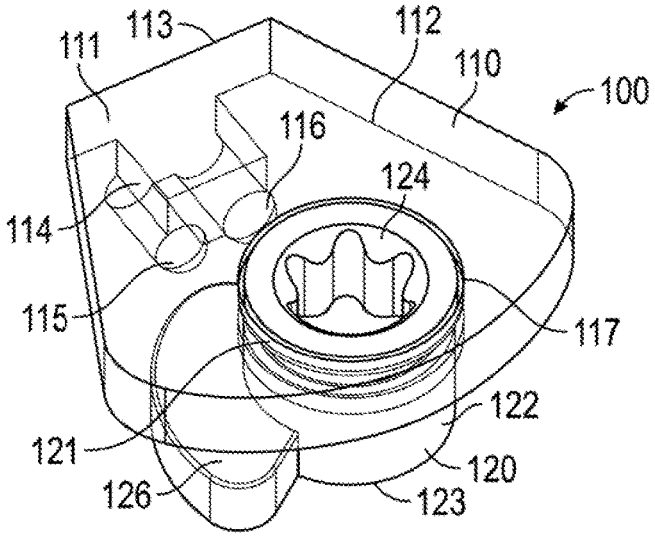
FIG. 4 is a partially translucent view of the slidable weight shown in FIG. 3.
Figure 8:
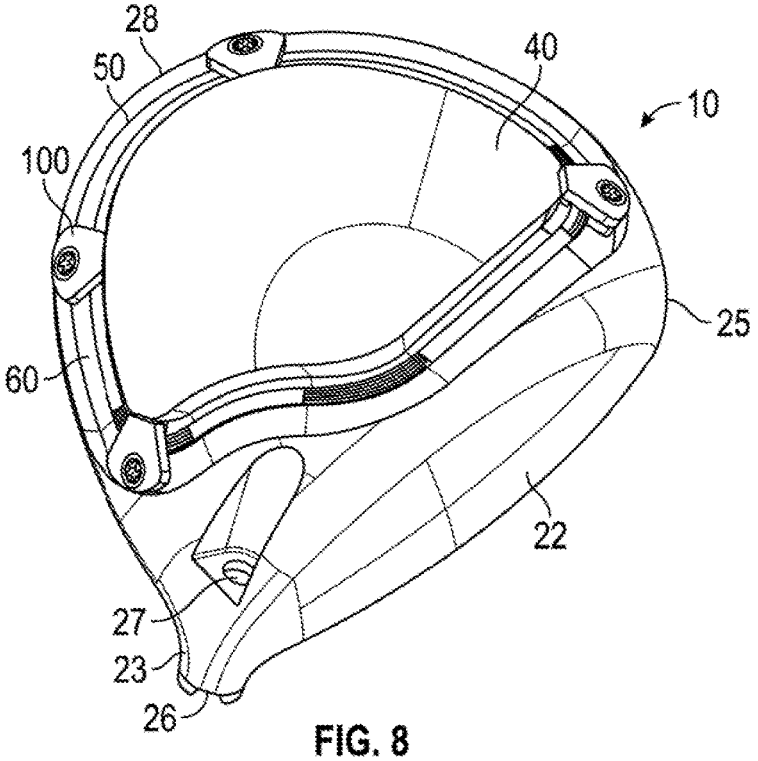
FIG. 8 is a sole perspective view of a second embodiment of the golf club head of the present invention engaged with a plurality of the slidable weights shown in FIG. 3.

As shown in FIGS. 2 and 8, the channel 50 is entirely contained on the sole 40, though in alternative embodiments the channel 50 may extend onto a ribbon or skirt portion or even onto the crown 30 of the golf club head 10. The channel 50 shapes illustrated in the embodiments shown in FIGS. 2 and 8 allow the weight to be moved along both the Y axis (heel side 23 to toe side 25) and the X axis (face 22 to rear edge 28) without requiring multiple channels—in other words, the single channel 50 of the present invention allows for greater mass property, and particularly center of gravity, adjustability than other club heads having only a single, unidirectional channel 50. If the channel 50 extends onto the ribbon or crown 30, then the mass properties of the club head 10 can be adjusted along the vertical Z axis as well.

Figure 7:
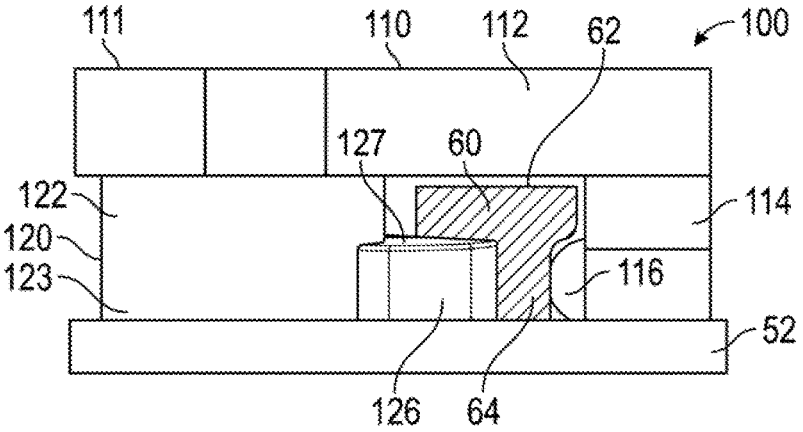
FIG. 7 is cross-sectional view of the slidable weight shown in FIG. 3 engaged with the rail shown in FIG. 1.

The channel 50 includes a single, L-shaped rail 60 that extends upwards from the floor 52 of the channel. The rail 60, which has a ledge 62 and a stem 64, preferably extends along the entire length of the channel 50, but in an alternative embodiment may terminate less than 1 inch from the end of the channel 50 to form an open area located proximate the through-bore 27, thereby creating an entry region where a slidable weight assembly 100 can be inserted into the channel 50. The ledge 62 extends approximately perpendicularly from the stem 64, as shown in FIG. 7.

The slidable weight assembly 100 of the present invention is unique in its mechanism and shape. As shown in FIGS. 3-7, the slidable weight assembly 100 has a body portion 110 and a rotatable cam portion 120 that acts as a gripping feature to engage the rail 60. The body portion 110 has an approximately L-shaped cross section, and includes a planar upper portion 112 that, when the slidable weight assembly 100 is engaged with the club head 10, is visible to a golfer when the golfer is viewing the sole 40 of the club head 10, and a base portion 114 extending perpendicular to the planar upper portion 112 from the edge 113 of the planar upper portion 112. The planar upper portion 112 has an upper surface 111 that can be decorated in any way desired by the manufacturer or golfer. For example, the upper surface 111 may include different colors, textures, and/or logos, either painted or formed directly on the upper surface 111 or applied via a decal, to enhance the aesthetic appearance of the club head 10. The planar upper portion 112 also includes an opening 117 to receive an upper end 121 of the cylindrical body 122 of the rotatable cam portion 120, which is preferably permanently trapped, but rotatable, within the opening 117. The base portion 114 includes a pair of rounded nubs 115, 116 extending perpendicular to the base portion 114 under the planar upper portion 112 and parallel with the planar upper portion 112. The body portion 110 preferably is composed of a material such as stainless steel, tungsten alloy, or another higher-density material.

Figure 5:
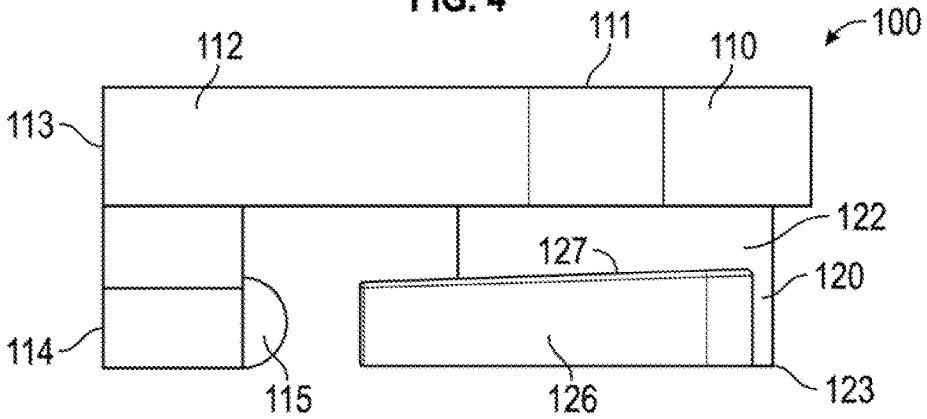
FIG. 5 is a side plan view of the slidable weight shown in FIG. 3.
Figure 6:
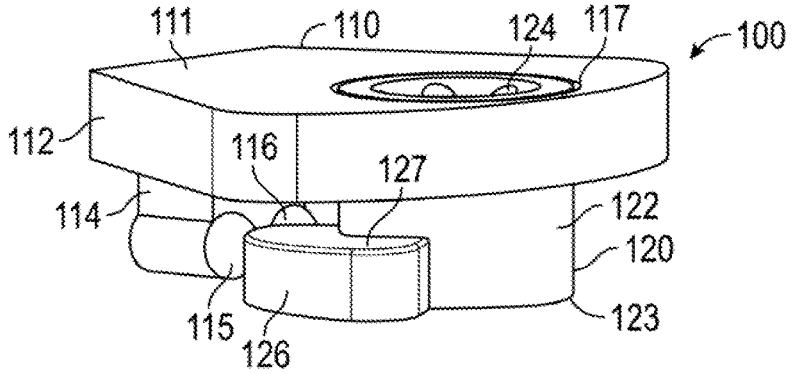
FIG. 6 is a side perspective view of the slidable weight shown in FIG. 3.

The rotatable cam portion 120 comprises a cylindrical body 122 with a tool engagement feature 124 (e.g., a Philips or flathead screwdriver receiver or a Torx® wrench receiver) and a curved protrusion 126 extending perpendicularly from the lower end 123 of the cylindrical body 122. The curved protrusion 126 only extends part of the way around the cylindrical body 122, and preferably less than half of the way around the cylindrical body 122, so that the slidable weight assembly 100 can have locked and unlocked configurations. As shown in FIG. 5, the curved protrusion 126 comprises a helical upper surface 127 that draws the slidable weight assembly 100 against the rail 60 when the curved protrusion 126 is moved into its locked configuration. The rotatable cam portion 120 preferably is composed of a material that has a lower density than that of the body portion 110, such as aluminum, plastic, rubber, or other polymer materials.

The slidable weight assembly 100 can be inserted into the channel 50 by turning the rotatable cam portion 120 to an unlocked position, such that the curved protrusion 126 is approximately perpendicular to the rounded nubs 115, 116, and hooking the base portion 114 of the body portion 110 over the rail 60. The slidable weight assembly 100 can then be moved to any point in the channel 50 desired by the golfer. Once the slidable weight assembly 100 is in its selected place, the golfer can use a tool to engage the tool engagement feature 124 and rotate the rotatable cam portion 120 until the curved protrusion 126 slides under the ledge 62 of the rail 60 and is located directly opposite to, and approximately parallel with, the rounded nubs 115, 116. The slidable weight assembly 100 preferably is dimensioned in such a way that the rail 60 is gripped between the curved protrusion 126 and the rounded nubs 115, 116, but is not contacted by any other part of the slidable weight assembly 100. In some embodiments, the curved protrusion 126 and the rounded nubs 115, 116 may be co-molded with a high friction material such as rubber to ensure that the slidable weight assembly 100 securely grips the rail 60 when in its locked position and to reduce rattling of the slidable weight assembly 100 when the golf club head 10 is in use.

In the preferred embodiment disclosed herein, the body 20 of the golf club head 10 preferably is formed from a metal material, while the crown 30 is formed from a non-metal material such as composite. In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A golf club head comprising:

a body comprising a hosel, a striking face, a heel side, a toe side, a rear side, a sole, and a channel in the sole; and a slidable weight assembly comprising a weight body and a rotatable portion, wherein the weight body comprises a planar upper portion, a base portion extending from and perpendicular to the planar upper portion, and at least one rounded nub extending from and approximately perpendicular to the base portion, wherein the rotatable portion comprises a cylindrical body and a curved protrusion extending from and approximately perpendicular to a lower end of the cylindrical body, wherein the curved protrusion extends only partially around the cylindrical body, wherein the planar upper portion comprises an opening sized to receive an upper end of the cylindrical body, wherein the channel comprises a floor and rail extending from and approximately perpendicular to the floor, wherein the rail comprises a stem and a ledge extending approximately perpendicular to and away from the stem, wherein the ledge is spaced from, and approximately parallel with, the floor, and wherein rotating the rotatable portion causes at least a portion of the curved protrusion to slide under the ledge and reversibly fixes the slidable weight assembly to the rail.

2. The golf club head of claim 1, wherein the curved protrusion and the at least one rounded nub are the only portions of the slidable weight assembly that contact the rail when at least a portion of the curved protrusion is disposed under the ledge.

3. The golf club head of claim 1, wherein the channel has a configuration selected from the group consisting of a closed loop and an S-shape.

4. The golf club head of claim 1, wherein the curved protrusion comprises a helical upper surface.

5. The golf club head of claim 1, wherein the weight body is composed of a first material having a first density, wherein the rotatable portion is composed of a second material having a second density, and wherein the first density is greater than the second density.

6. The golf club head of claim 1, wherein at least one of the at least one rounded nub and the curved protrusion is co-molded with a high friction material.

7. The golf club head of claim 6, wherein the high friction material is rubber.

8. The golf club head of claim 1, wherein the at least one rounded nub comprises first and second rounded nubs, and wherein each of the first and second rounded nubs are disposed beneath the planar upper portion.

9. The golf club head of claim 1, wherein the curved protrusion extends less than halfway around the cylindrical body.

10. The golf club head of claim 1, wherein the upper end of the cylindrical body comprises an upper surface having a tool engagement feature.

11. The golf club head of claim 1, wherein the upper end of the cylindrical body is permanently trapped within the opening.

12. The golf club head of claim 1, wherein the golf club head is selected from the group consisting of a driver-type head, a fairway wood-type head, and a hybrid-type head.

13. The golf club head of claim 1, further comprising a composite crown, wherein the body is composed of a metal alloy.

14. A weight assembly comprising:

a weight body comprising a planar upper portion, a base portion extending from and perpendicular to the planar upper portion, and first and second rounded nubs extending from and perpendicular to the base portion; and a rotatable portion comprising a cylindrical body, a tool engagement feature, and a curved protrusion extending from and perpendicular to the cylindrical body, wherein the planar upper portion comprises an opening sized to receive an upper end of the cylindrical body, wherein the upper end of the cylindrical body is permanently trapped within the opening, wherein each of the first and second rounded nubs are disposed beneath the planar upper portion, wherein the curved protrusion extends less than halfway around the cylindrical body, and wherein the curved protrusion comprises a helical upper surface.

15. The weight assembly of claim 14, wherein the weight body is composed of a first material having a first density, wherein the rotatable portion is composed of a second material having a second density, and wherein the first density is greater than the second density.

16. The weight assembly of claim 15, wherein the first material is a tungsten alloy and wherein the second material is a polymer material.

17. The weight assembly of claim 15, wherein at least one of the first and second rounded nubs and the curved protrusion is co-molded with a high friction material.

18. The weight assembly of claim 15, wherein each of the first and second rounded nubs and the curved protrusion is co-molded with rubber.

19. The weight assembly of claim 14, wherein the curved protrusion extends from a lower end of the cylindrical body.

20. The weight assembly of claim 14, further comprising a decal, wherein the planar upper portion comprises an upper surface, and wherein the decal is permanently affixed to the upper surface.

* * * * *